US008468726B1

(12) United States Patent
Hetrick

(10) Patent No.: US 8,468,726 B1
(45) Date of Patent: Jun. 25, 2013

(54) METHOD OF RECESSED EXIT SIGN INSTALLATION FOR MINIMAL DISTURBANCE OF CEILING AESTHETICS

(75) Inventor: Westly Davis Hetrick, Atlanta, GA (US)

(73) Assignee: Cooper Technologies Company, Houston, TX (US)

( * ) Notice: Subject to any disclaimer, the term of this patent is extended or adjusted under 35 U.S.C. 154(b) by 493 days.

(21) Appl. No.: 12/776,605

(22) Filed: May 10, 2010

(51) Int. Cl.
*G09F 3/18* (2006.01)

(52) U.S. Cl.
USPC ..... 40/546; 362/365; 362/812

(58) Field of Classification Search
USPC ..... 40/546, 564, 570; 362/148, 364, 362/365
See application file for complete search history.

(56) References Cited

U.S. PATENT DOCUMENTS

| | | | | |
|---|---|---|---|---|
| 2,626,120 | A | 1/1953 | Baker | |
| 3,296,431 | A * | 1/1967 | Green | 40/570 |
| 3,995,798 | A | 12/1976 | Nikolaus et al. | |
| 4,385,343 | A * | 5/1983 | Plumly | 362/614 |
| 5,950,340 | A * | 9/1999 | Woo | 40/564 |
| 6,135,620 | A * | 10/2000 | Marsh | 362/377 |
| D460,575 | S | 7/2002 | Tergny et al. | |
| 6,539,657 | B1 * | 4/2003 | Qualls et al. | 40/546 |
| 6,788,256 | B2 * | 9/2004 | Hollister | 343/700 MS |
| D551,382 | S | 9/2007 | Curtin | |
| 7,287,347 | B2 * | 10/2007 | Hasan | 40/553 |
| D556,075 | S | 11/2007 | Teiber et al. | |
| D577,454 | S | 9/2008 | Maxik et al. | |
| D592,348 | S | 5/2009 | Trott et al. | |
| D601,741 | S | 10/2009 | Trott et al. | |
| D614,338 | S | 4/2010 | Sieczkowski et al. | |
| 7,771,085 | B2 * | 8/2010 | Kim | 362/285 |
| D659,194 | S * | 5/2012 | Hetrick | D20/42 |
| 2008/0232116 | A1 * | 9/2008 | Kim | 362/365 |

* cited by examiner

*Primary Examiner* — Casandra Davis
(74) *Attorney, Agent, or Firm* — King & Spalding LLP

(57) ABSTRACT

A recessed exit sign includes an electrical component housing, a plaster ring, and an illuminated message panel. The lighting assembly includes an electrical component assembly, an internal power source housed within the electrical component assembly, a light source housed within the electrical component assembly, and a lens. The power source is electrically coupled to the light source. A portion of the lens is inserted into an opening formed within the electrical component assembly and coupled to the electrical component assembly. The lens extends from within the electrical component assembly to a location outside the electrical component assembly. A portion of the lighting assembly is slidably inserted through the plaster ring and into the electrical component housing. When plaster is applied over the plaster ring the lens appears to simply enter a hole in the ceiling with not additional features visible on the ceiling surface to cause a distraction.

21 Claims, 8 Drawing Sheets

FIG. 5A
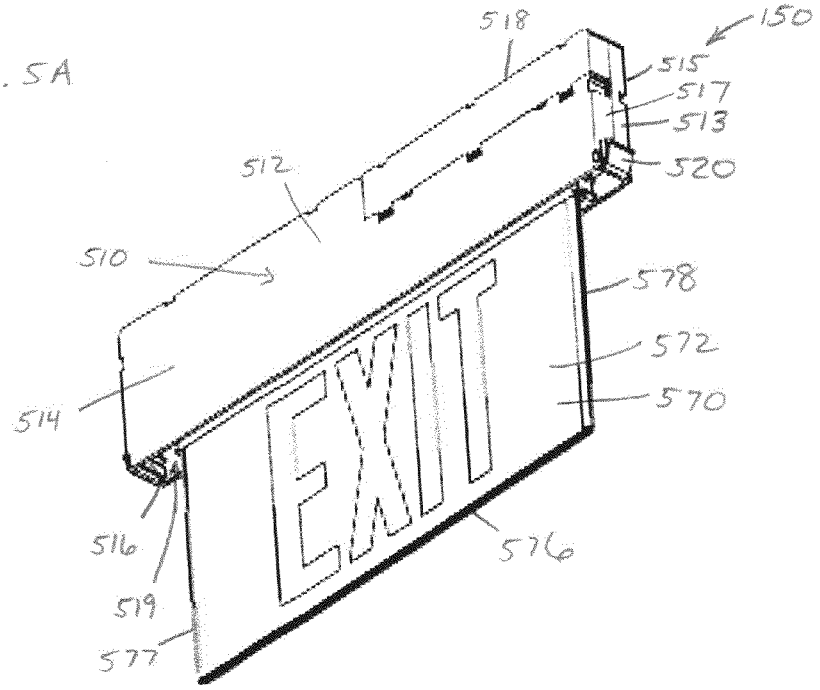
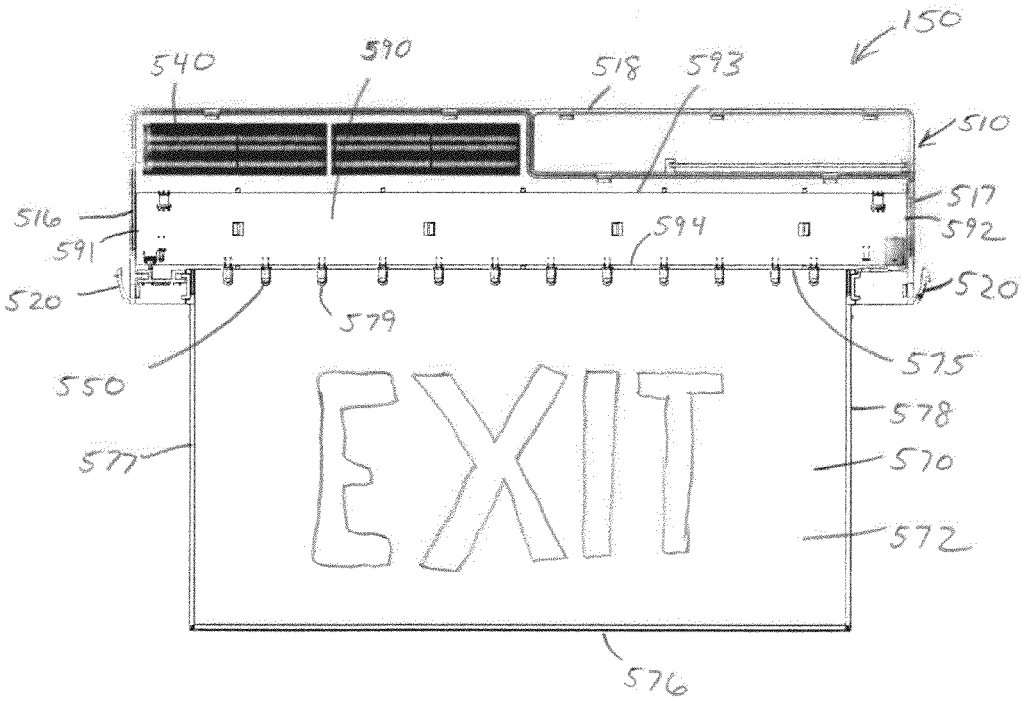
FIG. 5B

METHOD OF RECESSED EXIT SIGN INSTALLATION FOR MINIMAL DISTURBANCE OF CEILING AESTHETICS

TECHNICAL FIELD

The present invention relates generally to lighted signs. More particularly the present invention relates to lighted exit signs having recessed electrical controls.

BACKGROUND

Under National Fire Protection Association (NFPA), National Electrical Code (NEC), Underwriters Laboratories (UL) and local fire and building codes for each state, buildings that provide public access are required by law to have signs therein identifying the exits. These emergency signs are required to exhibit a specific amount of illumination and often times are required to have an emergency backup power source to provide emergency illumination to the exit sign for a specified period of time when electrical power to the building is interrupted to allow sufficient time for persons in the building to vacate.

Originally, an exit sign used standard incandescent lamps. The earliest alternatives to incandescent lamps were radioactive tritium gas and compact fluorescent lamps. In 1985, light-emitting diodes (LEDs) were introduced for use in exit signs. The most cost-effective alternative today over the exit signs that use incandescent lamps are LED exit signs. A standard LED exit sign generally uses only about 1 to 5 watts of power per surface. Because LEDs also last considerably longer than incandescent lamps, life cycle savings are dramatic.

There are currently several different types of LED exit signs available in the marketplace using a variety of LEDs in different configurations. There are a great number of LED sign manufacturers competing in the market. As a result, there is a wide range in price, quality, and energy consumption. Some LED signs use as few as 6 LEDs, others use 18 to 35 LEDs, and some use up to 200 LEDs. The rated energy consumption can thus range from as little as 1 watt up to 8 watts.

Architects, building owners, and many users desire to use recessed exit signs and/or other recessed emergency lighting devices to eliminate, or substantially reduce, visual lighting distractions on the ceiling, thereby having quiet ceilings. Conventional recessed exit signs include a recessed housing, an aluminum access plate that covers the opening in the ceiling and extends down from the surface of the ceiling, and a lens that is lighted through an edge using one or more LEDs.

When installing conventional recessed exit signs, the large housing is initially installed before ceiling drywall is installed. The ceiling drywall is then installed below the large housing, thereby forming a ceiling plane. A large hole is cut into the ceiling drywall that surrounds the profile of the housing so that the housing is accessible from below the ceiling plane. The lens and the associated lighting elements are coupled into the housing so that the lens extends below the ceiling plane. Additionally, the large aluminum access plate is installed below the ceiling drywall to cover up the hole and the large housing. The access plate also surrounds the top portion of the lens that extends below the ceiling drywall. The aluminum access plate is removable and allows installers and maintenance personnel to have access to the internal lighting components.

When viewing the conventional recessed exit signs from below the ceiling plane, the aluminum access plate, or cover plate, and the lens is visible. In fact, with the large silver access plate back-dropped by an expansive white or off-white ceilings the human eye is actually drawn towards the access plate, which is not aesthetically pleasing. Architects, building owners, and the many users using the conventional recessed exit signs would prefer having quieter ceilings with less object visible to the human eye, thus preferring to not have the access plate be visible.

SUMMARY

One exemplary embodiment of the present invention is a recessed emergency lighting device. According to one exemplary embodiment, the recessed emergency lighting device can include an electrical component housing, a plaster ring, and an illuminated message panel. The electrical component housing can form a cavity therein. The plaster ring can include a plaster plate and a body. The plaster plate can form an opening therein. The body can extend outwardly from the perimeter of the opening. The body can be coupled to the electrical component housing. The illuminated message panel can include an electrical component assembly. The electrical component assembly can be inserted through the opening and into the cavity. The electrical component assembly can be positioned within the electrical component housing.

Another exemplary embodiment of the present invention is a recessed emergency lighting device. According to another exemplary embodiment, the recessed emergency lighting device can include an electrical component housing and an illuminated message panel. The electrical component housing can form a cavity therein. The illuminated message panel can include an electrical component assembly, a circuit board, one or more light emitting diodes (LEDs), and a lens. The electrical component assembly can include a top edge at one end and an aperture at an opposing end. The electrical component assembly can be slidably insertable into the cavity. The circuit board can include a first longitudinal end, a second longitudinal end, a first latitudinal end, and a second latitudinal end. The circuit board can be disposed within the electrical component assembly. The ends can form a circuit board profile. The second longitudinal end can be positioned adjacent the top edge. The first longitudinal end can be positioned adjacent the aperture. The LEDs can be coupled to the circuit board adjacent the first longitudinal end. The LEDs can extend beyond the circuit board profile. The lens can include a first longitudinal side and a second longitudinal side. The first longitudinal side can be inserted within the aperture and can be positioned adjacent the LEDs. The second longitudinal side can be positioned outside the electrical component assembly.

Another exemplary embodiment of the present invention is a method for installing a recessed emergency lighting device. According to another exemplary embodiment, the method can include mounting an electrical component housing to a support structure above a ceiling. The electrical component housing can include a slot. The method also can include installing the ceiling below the electrical component housing and adjacent the slot. The slot can face the ceiling. The method can also includes forming a hole in the ceiling around the slot and coupling a plaster ring to the electrical component housing. The plaster ring can include an opening, which can be aligned with the slot. A portion of the plaster ring can be below the ceiling and cover the edges of the hole. The method can also include sliding a portion of an illuminated message panel into the opening and the slot. The illuminated message panel can be coupled within the electrical component housing.

BRIEF DESCRIPTION OF THE DRAWINGS

The foregoing and other features and aspects of the invention are best understood with reference to the following description of certain exemplary embodiments, when read in conjunction with the accompanying drawings, wherein:

FIG. 5A is a perspective view of an electrical component assembly and message panel of FIG. 1A in accordance with an exemplary embodiment of the present invention;

FIG. 5B is a cross-sectional view of the electrical component assembly and message panel of FIG. 5A in accordance with an exemplary embodiment of the present invention.

The drawings illustrate only exemplary embodiments of the invention and are therefore not to be considered limiting of its scope, as the invention may admit to other equally effective embodiments.

BRIEF DESCRIPTION OF EXEMPLARY EMBODIMENTS

The present invention is directed to recessed exit signs that provide a minimal visual disturbance on the ceiling from which they are mounted. Although the description of exemplary embodiments is provided below in conjunction with recessed exit signs, alternate embodiments of the invention are applicable to other types of recessed emergency lighting devices. Additionally, although the description of exemplary embodiments is provided below in conjunction with LEDs in a recessed exit sign, alternate embodiments of the invention are applicable to other types of light sources in a recessed emergency lighting device including, but not limited to, organic light emitting diodes, fluorescent lights, or other types of suitable light sources known to people having ordinary skill in the art. Additionally, some embodiments of the present invention include light sources embodying lighting technology not yet developed.

Figure 1A:
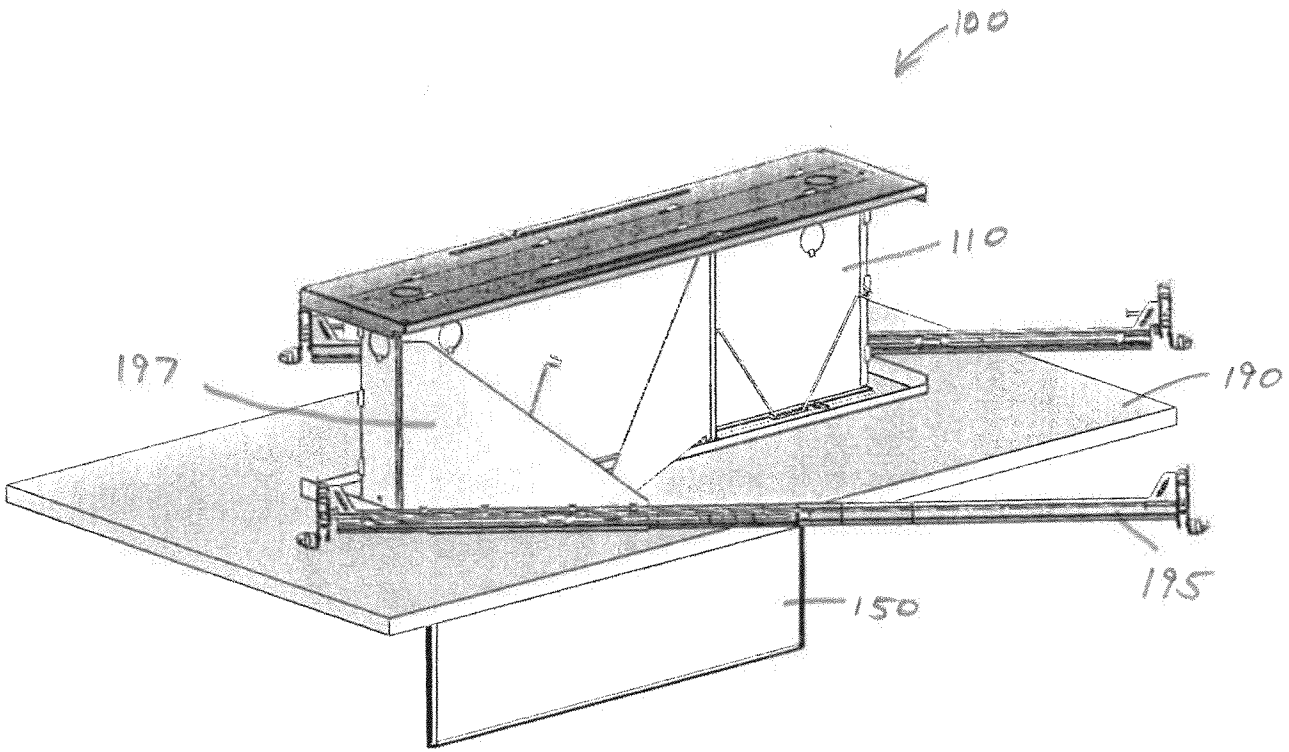
FIG. 1A is a perspective view of a recessed emergency lighting device installed within a ceiling in accordance with an exemplary embodiment of the present invention.
Figure 1B:
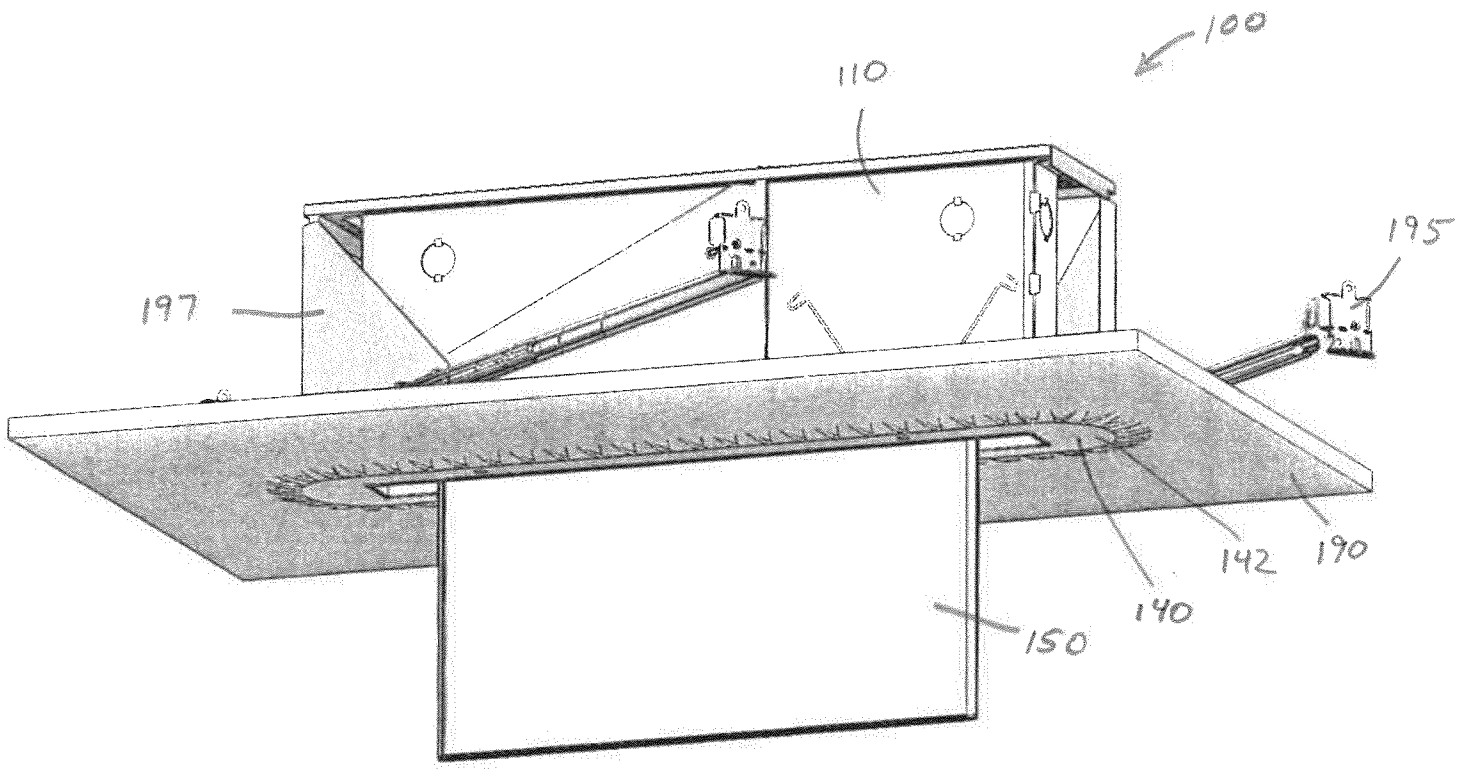
FIG. 1B is another perspective view of the recessed emergency lighting device of FIG. 1A in accordance with an exemplary embodiment of the present invention.
Figure 1C:
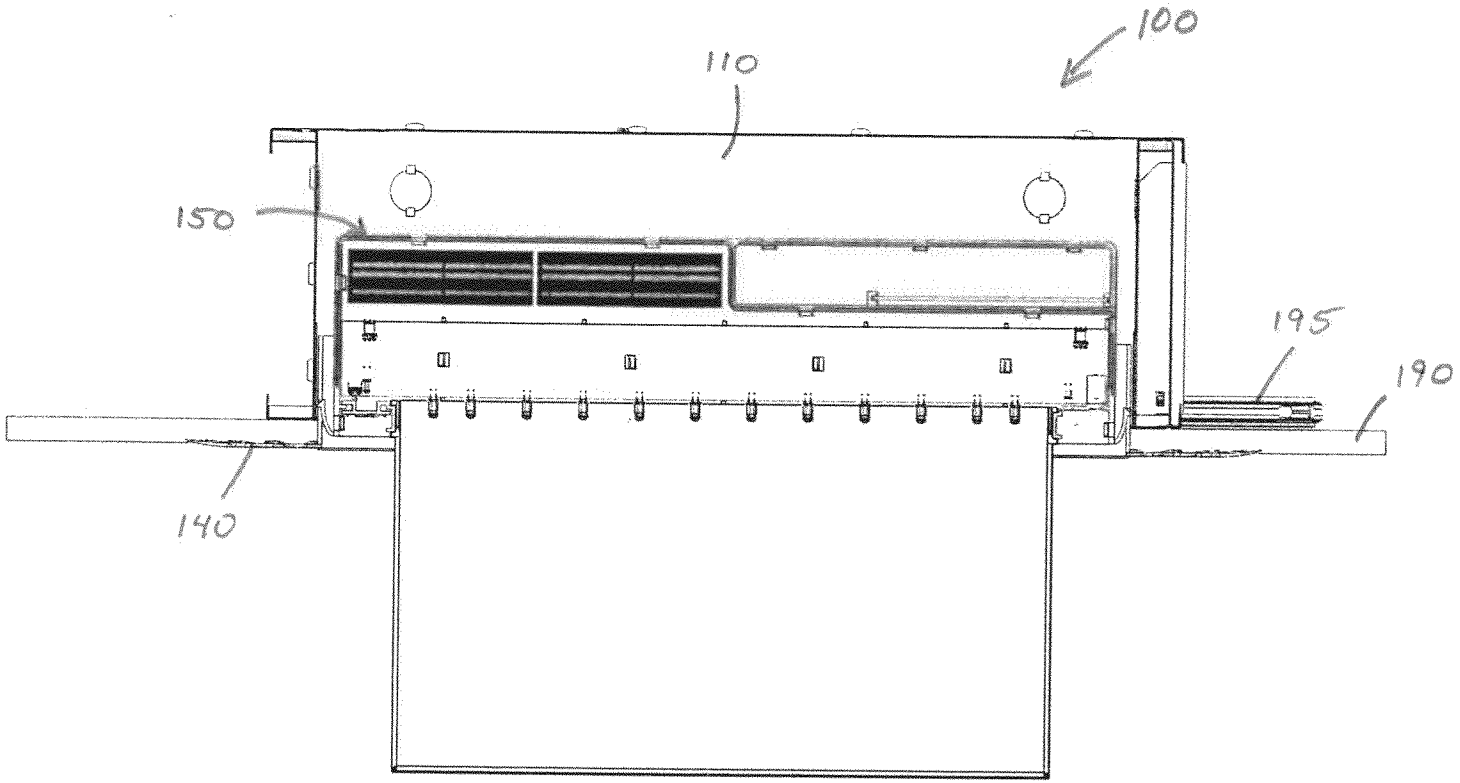
FIG. 1C is a cross-sectional view of the recessed emergency lighting device of FIG. 1A in accordance with an exemplary embodiment of the present invention.

The invention is better understood by reading the following description of non-limiting, exemplary embodiments with reference to the attached drawings, wherein like parts of each of the figures are identified by like reference characters, and which are briefly described as follows. FIG. 1A is a perspective view of a recessed emergency lighting device 100 in accordance with an exemplary embodiment of the present invention. FIG. 1B is another perspective view of the recessed emergency lighting device 100 of FIG. 1A. FIG. 1C is a cross-sectional view of the recessed emergency lighting device 100 of FIG. 1A. Referring to FIGS. 1A-C, the recessed emergency lighting device 100 includes an electrical component housing 110, a plaster ring 140, and an illuminated message panel 150. In one exemplary embodiment, a portion of the message panel 150 is inserted through the plaster ring 140 and into the electrical component housing 110.

In certain exemplary embodiments, the recessed emergency lighting device 100 is coupled to support beams (not shown) located above the ceiling 190 using one or more hanger bars 195. Alternatively, other coupling devices known to those of ordinary skill in the art having the advantage of this disclosure could be substituted for the hangar bars including, but not limited to, screws, nails, and/or bolts. Each hanger bar 195 is coupled to the electrical component housing 110 using a rotatable wing 197. Each wing 197 is rotatable and allows each hanger bar 195 to be oriented in several intermediate positions within a same plane that is parallel to the ceiling 190. For example, the hanger bars 195 are rotatable approximately ninety degrees about a vertical axis and are positionable at any intermediate angle between being parallel or substantially parallel with the longitudinal horizontal axis of device 100 and being orthogonal or substantially orthogonal to the longitudinal horizontal axis of the device 100. Although the hanger bars 195 are described as being capable of ninety degrees of rotation, the hanger bars 195 are rotatable at greater or lesser amounts in other exemplary embodiments.

The wings 197 provide flexibility in positioning and coupling the electrical component housing 110 of the recessed emergency lighting device 100 to support beams located above the ceiling 190. Additionally, the hanger bars 195 are extended and/or retracted depending upon the spacing between adjacent support beams. Although the use of hanger bars 195 is an exemplary device used to couple the electrical component housing 110 to one or more support beams above the ceiling 190, other devices known to people having ordinary skill in the art are used to couple the electrical component housing 110 to the support beams, or other supporting structure in alternative exemplary embodiments. In certain exemplary embodiments, the hanger bars 195 and the wings 197 are fabricated using aluminum; however, one or more of the hanger bars 195 and the wings 197 are capable of being fabricated using other suitable materials known to people having ordinary skill in the art, including, but not limited to, steel, plastics, metal alloys, polymers, and other suitable metals in other exemplary embodiments.

Figure 2A:
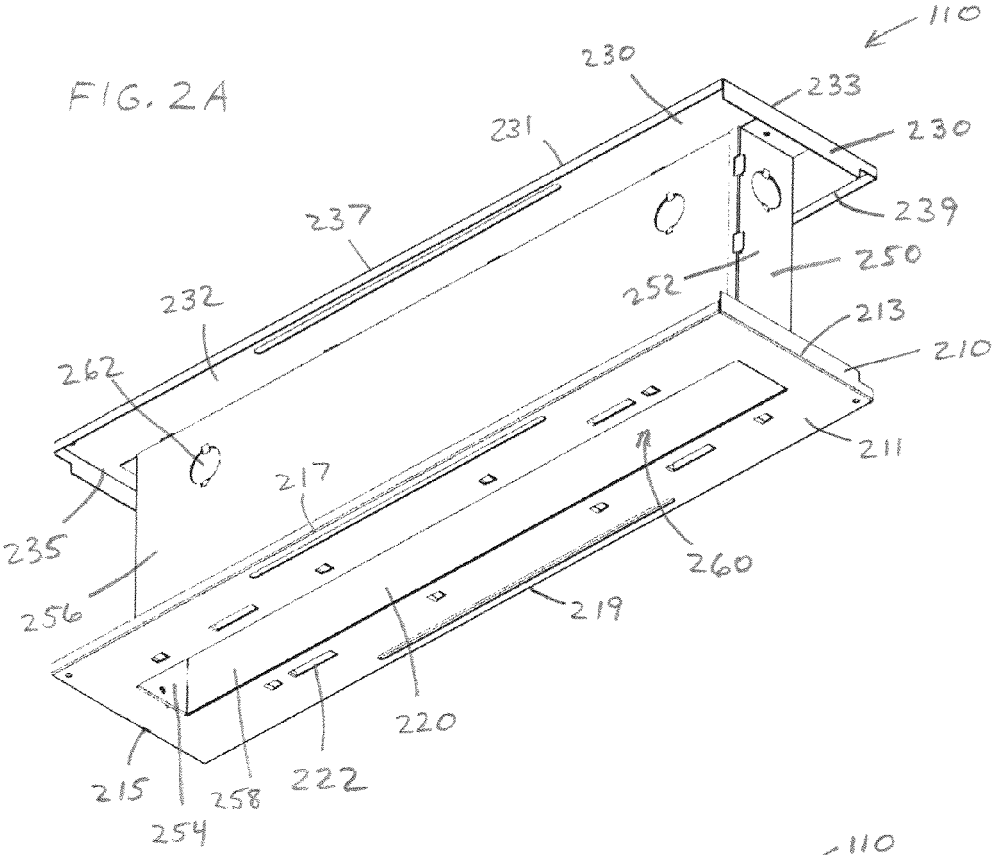
FIG. 2A is a perspective view of an electrical component housing of the recessed emergency lighting device of FIG. 1A in accordance with an exemplary embodiment of the present invention.
Figure 2B:
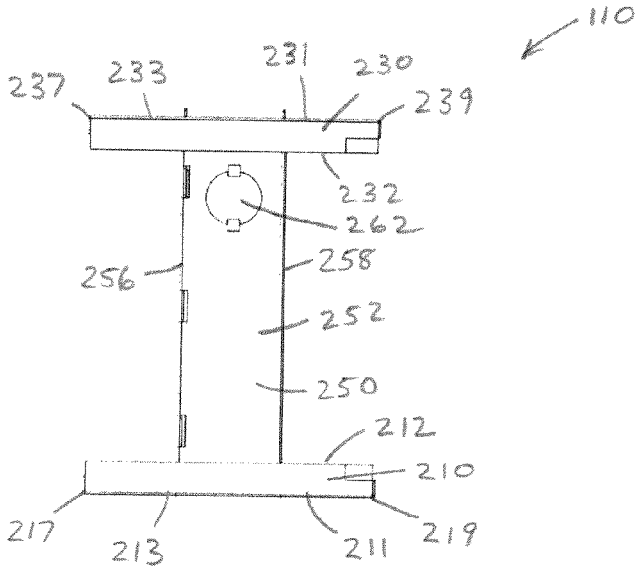
FIG. 2B is a side elevation view of the electrical component housing of FIG. 2A in accordance with an exemplary embodiment of the present invention.

FIG. 2A is a perspective view of the electrical component housing 110 of the recessed emergency lighting device 100 of FIG. 1A in accordance with an exemplary embodiment of the present invention. FIG. 2B is a side elevation view of the exemplary electrical component housing 110 of FIG. 2A. Referring to FIGS. 1A-C and 2A-B, the electrical component housing 110 includes a first plate 210, a second plate 230, and a body 250 extending from the first plate 210 to the second plate 230. In certain exemplary embodiments, the first plate 210, the second plate 230, and the body 250 are fabricated with aluminum. In alternative exemplary embodiments, one or more of the first plate 210, the second plate 230, and the body 250 are fabricated using other suitable materials known to people having ordinary skill in the art, including, but not limited to, plastics, steel, metal alloys, polymers, and other suitable metals The first plate 210 is substantially rectangularly-shaped and includes a first surface 211, a second surface 212, a first lateral edge 213, a second lateral edge 215 opposite and substantially parallel to the first lateral edge 213, a first longitudinal edge 217, and a second longitudinal edge 219 opposite and substantially parallel to the first longitudinal edge 217. The first and second longitudinal edges 217 and 219 extend from the first lateral edge 213 to the second lateral edge 215, thereby forming the profile of the first plate 210. Although the first plate 210 is rectangularly-shaped in certain exemplary embodiments, the first plate 210 is capable of having other geometric or non-geometric shapes.

The first plate 210 also includes a slot 220 defining an aperture that extends from the first surface 211 to the second surface 212. In certain exemplary embodiments, the slot 220 is surrounded by a portion of the first plate. In certain exemplary embodiments, the slot 220 is substantially rectangular in shape. However, in alternative embodiments, the slot 220 is capable of being shaped in other geometric or non-geometric shapes. The slot 220 is shaped to receive a portion of the illuminated message panel 150, which is discussed in further detail below with reference to FIGS. 5A and 5B. According to one exemplary embodiment, the slot 220 is about 1.5 inches wide and about 17.4 inches long; however, the dimensions are variable in other exemplary embodiments.

According to certain exemplary embodiments, the first plate 210 also includes one or more torsion spring receivers 222 positioned adjacent the perimeter of the slot 220 and defining an aperture in the first plate 210 that extends from the first surface 211 to the second surface 212. In certain exemplary embodiments, the torsion spring receivers 222 are substantially rectangular in shape. Alternatively the torsion spring receivers 222 are capable of being shaped in other geometric or non-geometric shapes. In these exemplary embodiments, the torsion spring receivers 222 are shaped to receive a portion of a torsion spring 400 (FIG. 4) to couple the plaster ring 140 to the electrical component housing 110. However, according to other exemplary embodiments, another portion of the electrical component housing 110 includes the torsion spring receivers 222 for coupling the plaster ring 140 to the electrical component housing 110 without departing from the scope and spirit of the exemplary embodiment.

The second plate 230 is substantially rectangularly-shaped and includes a first surface 231, a second surface 232, a first lateral edge 233, a second lateral edge 235 opposite and substantially parallel to the first lateral edge 233, a first longitudinal edge 237, and a second longitudinal edge 239 opposite and substantially parallel to the first longitudinal edge 237. The first and second longitudinal edges 237 and 239 extend from the first lateral edge 233 to the second lateral edge 235, thereby forming the profile of the second plate 230. In certain exemplary embodiments, the second plate 230 is shaped substantially similar to the shape of the first plate 210. Although the second plate 230 is rectangularly-shaped in certain exemplary embodiments, the second plate 230 is shaped in any other geometric or non-geometric shape according to other exemplary embodiments.

The body 250 has a substantially rectangularly-shaped profile and includes a first lateral side panel 252, a second lateral side panel 254 opposite and substantially parallel to the first lateral side panel 252, a first longitudinal side panel 256, and a second longitudinal side panel 258 opposite and substantially parallel to the first longitudinal side panel 256. The first and second longitudinal side panels 256 and 258 extend from the first lateral side panel 252 to the second lateral side panel 254, thereby forming the profile of the body 250. The body 250 also forms a cavity 260, which has the profile the same as or substantially similar to the profile of the slot 220 when viewed from the first surface 211 of the first plate 210. In certain exemplary embodiments, the body 250 includes one or more conduit knock-outs 262, which are removable and/or manually deformable to allow one or more electrical wires (not shown) to pass from the exterior of the body 250 to the interior of the body 250 through an aperture created by the removal or deformation of the knock-out 262. These conduit knock-outs 262 typically provide a barrier between the interior and the exterior of the body 250 when not in use. In other exemplary embodiments, the conduit knock-outs 262 are positioned on either the body 250, the second plate 230, or on both. In one exemplary embodiment, the body 250 is about 17.5 inches in length and about 1.6 inches in width; however, the dimensions are variable in other exemplary embodiments.

The body 250 is positioned on the second surface 212 of the first plate 210 and disposed over the slot 220 such that the outer profile of the body 250 surrounds or aligns with the profile of the slot 220. Thus, the slot 220 is positioned adjacent the cavity 260 to allow a portion of the illuminated message panel 150 to be inserted through the slot and into the cavity 260. The body 250 is coupled to the first plate 210 using coupling devices and/or methods known to people having ordinary skill in the art, including, but not limited to, welding, snap-fittings, rivets, or screws. The second surface 232 of the second plate 230 is positioned over the cavity 260 of the body 250 and coupled thereto using coupling devices and/or methods known to people having ordinary skill in the art, including, but not limited to, welding, snap-fittings, rivets, or screws. Thus, once the first plate 210 and the second plate 230 are coupled to the body 250 to form the electrical component housing 110, the cross-section of the exemplary electrical component housing 110 is substantially "I-shaped." In one exemplary embodiment, the height of the electrical component housing 110, which includes the first plate 210, the body 250, and the second plate 230, is about 6.0 inches; however, this dimension is variable in other exemplary embodiments. Although one example of an electrical component housing 110 is described herein, other types and shapes of electrical component housings are capable of being substituted for the exemplary housing 110 in alternative exemplary embodiments without departing from the scope and spirit of the exemplary embodiment.

Figure 3:
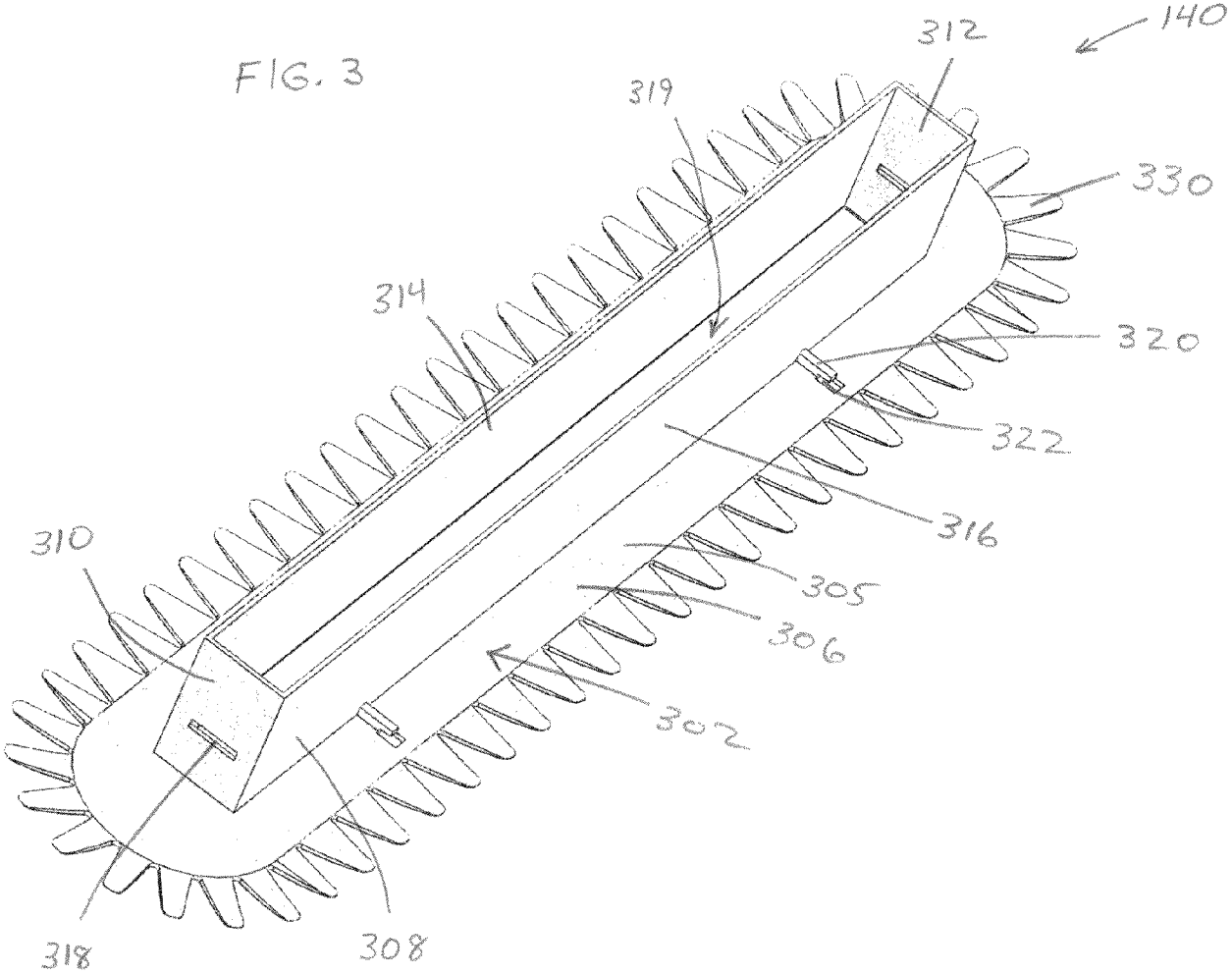
FIG. 3 is a perspective view of a plaster ring of the recessed emergency lighting device of FIG. 1B in accordance with an exemplary embodiment of the present invention.

FIG. 3 is a perspective view of the plaster ring 140 for the recessed emergency lighting device 100 of FIG. 1B in accordance with an exemplary embodiment of the present invention. Referring to FIGS. 1B and 3, the plaster ring 140 includes a plaster plate 302 and a plaster body 308 extending upward in a substantially orthogonal direction from the plaster plate 302. The exemplary plaster ring 140 is fabricated from plastic; however, in alternative embodiments, one or both of the plaster plate 302 and the plaster body 308 are fabricated using other suitable materials known to people having ordinary skill in the art, including, but not limited to, aluminum, polymers, or other suitable materials.

In the exemplary embodiment of FIG. 3, the plaster plate 302 has a substantially oval shape. Alternatively, other geometric or non-geometric shapes for the plaster plate 302 are within the scope and sprit of this disclosure. In one exemplary embodiment, the plaster plate 302 has a thickness of about eighty thousandths (0.080) of an inch towards the interior portion of the plaster plate 302, while the thickness is about twenty thousandths (0.020) of an inch along the perimeter of the plaster plate. These exemplary dimensions provide support for the electrical component housing 110, while allowing for improved blending of the ceiling 190 to the plaster plate 302 when plaster or some other coating is applied over the plaster plate 302 to blend the plaster plate 302 into the ceiling plane. Alternatively, the dimensions for the plaster plate are capable of modification. The plaster plate 302 includes a base 305, a plurality of teeth 330, and one or more raised protrusions 320. The base 305 includes a first side 306, a second side 142, and an aperture 319 extending from the first side 306 to the second side 142. Upon installing the recessed emergency lighting device 100, the first side 306 faces the ceiling 190, while the second side 142 faces the floor (not shown), or ground. According to some exemplary embodiments, the second side 142 is textured to facilitate placing plaster thereon so that the second side 142 is blended into the bottom surface of the ceiling 190. However, in other exemplary embodiments, the second side 142 is substantially smooth without departing from the scope and spirit of the exemplary embodiment. In certain exemplary embodiments, the aperture 319 is substantially rectangular in shape. However, in alternative embodiments, the aperture 319 is capable of having a different shape. In certain exemplary embodiments, the aperture 319 is surrounded by material used to fabricate the base 305.

Figure 6:
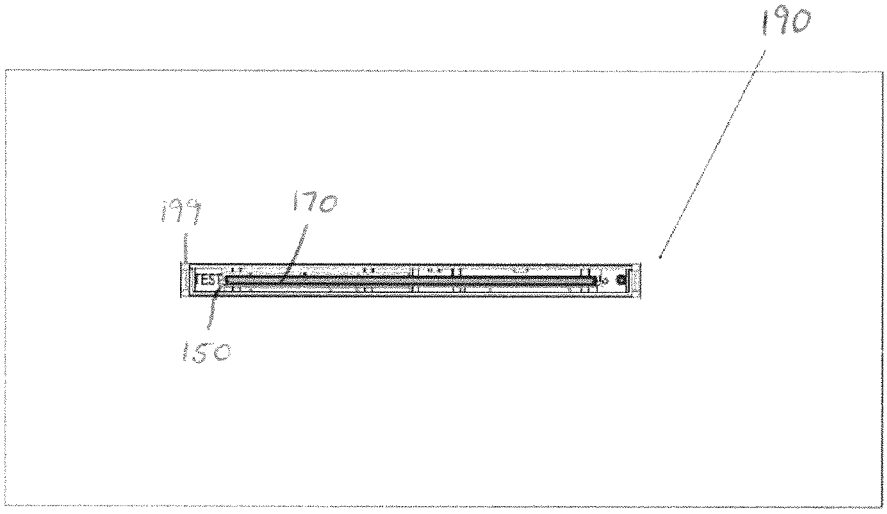
FIG. 6 shows a bottom plan view of the recessed emergency lighting device of FIG. 1A installed within the ceiling where plaster is applied over and about the plaster ring to blend the base of the plaster ring into the surface of the ceiling in accordance with an exemplary embodiment of the present invention.

The exemplary teeth 306 extend radially and outwardly from the perimeter of the base 305. In certain exemplary embodiments, the teeth 306 are flexible and are oriented in a direction extending outward and slightly upward in order to improved engagement between the teeth 306 and the bottom surface of the ceiling 190. In certain exemplary embodiments, the portion of the teeth 306 adjacent the perimeter of the base 305 is thicker than the portion of the teeth 306 distal the perimeter of the base 305. This thickness reduction facilitates the blending of the base 305 into the surface of the ceiling 190 when plaster is applied over and about the base 305 in such a manner that the ceiling 190 and the second side 142 appear as ceiling 190 only as shown in FIG. 6. However, in alternate exemplary embodiments, the second side 142 appears differently from the ceiling 190.

The raised protrusion 320 extends outwardly in an orthogonal or substantially orthogonal manner above the first surface 306 and forms a notch 322 between a portion of the raised protrusion 320 and the first surface 306. In one exemplary embodiment there are four raised protrusions 320 and four respective notches 322 but those or ordinary skill in the art will recognize that fewer or greater numbers of protrusions 320 are within the scope and sprit of this disclosure. In certain exemplary embodiments, each raised protrusion 320 is aligned with a corresponding torsion spring receiver 222 (FIG. 2A) of the electrical component housing's first plate 210 (FIG. 2A) when the plaster ring 140 is coupled to the electrical component housing 110.

The plaster body 308 extends orthogonally or substantially orthogonally upward from the first surface 306 surrounding the perimeter of the aperture 319. The exemplary plaster body 308 has a substantially rectangularly-shaped profile and includes a first lateral boundary 310, a second lateral boundary 312 opposite and substantially parallel to the first lateral boundary 310, a first longitudinal boundary 314, and a second longitudinal boundary 316 opposite and substantially parallel to the first longitudinal boundary 314. The first and second longitudinal boundaries 314 and 316 extend from the first lateral boundary 310 to the second lateral boundary 312, thereby forming the profile of the plaster body 308. In some exemplary embodiments, each of the first lateral boundary 310 and the second lateral boundary 312 include a snap slot 318. The snap slot 318 facilitates coupling of the illuminated message panel 150 to the plaster ring 140 once a portion of the illuminated message panel 150 is inserted through the aperture 319 of the plaster ring 140 and the slot 220 (FIG. 2A) of the electrical component housing 110. The plaster body 308 is dimensioned to fit through the slot 220 (FIG. 2A) and within the cavity 260 (FIG. 2A) of the electrical component housing 110.

Figure 4:
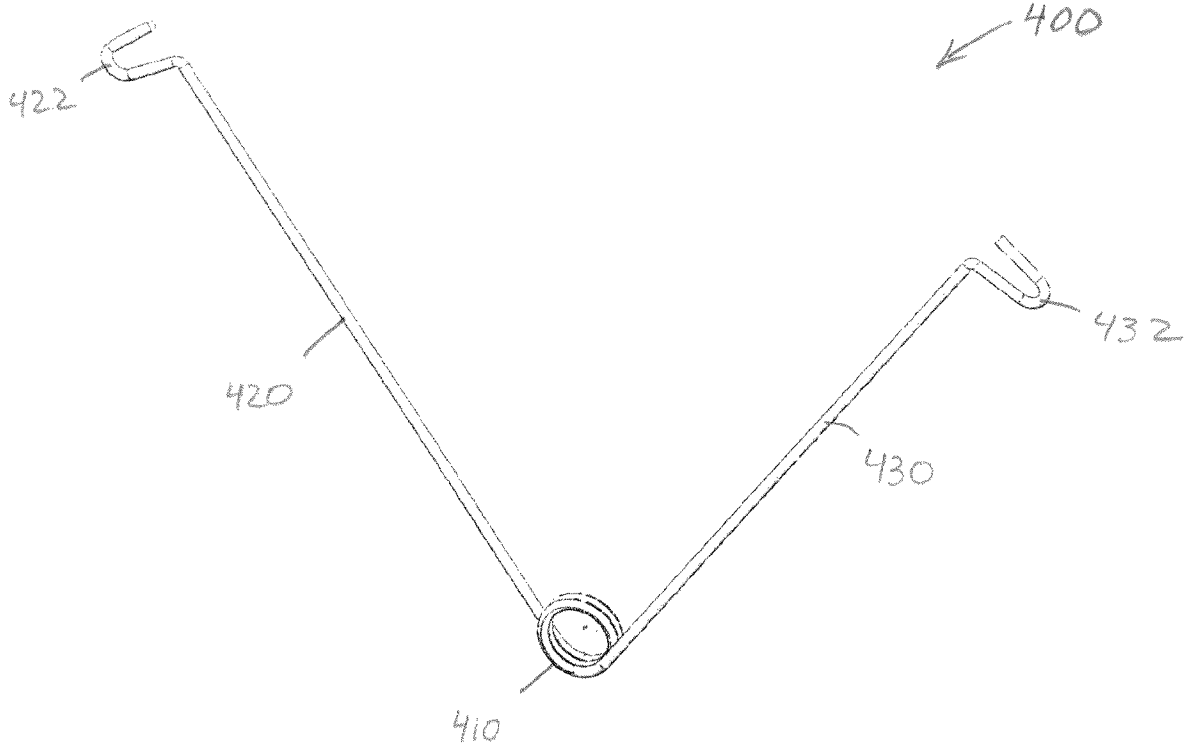
FIG. 4 is a perspective view of a torsion spring of the recessed emergency lighting device of FIG. 1A in accordance with an exemplary embodiment of the present invention.

FIG. 4 is a perspective view of a torsion spring 400 of the recessed emergency lighting device 100 of FIG. 1A in accordance with an exemplary embodiment of the present invention. Each torsion spring 400 includes a ring base 410, a first bracket 420 extending from the ring base 410 in a first direction, and a second bracket 430 extending from the ring base 410 in a second direction. In one exemplary embodiment, the torsion spring 400 is substantially v-shaped when a force is not being applied to it. The first bracket 420 includes a first bracket end 422 and the second bracket includes a second bracket end 432. A portion of the ring base 410 of each torsion spring 400 is inserted into a respective notch 322 (FIG. 3) of the plaster ring 140. Each of the brackets 420 and 430 are designed to be flexed together so that the bracket ends 422 and 433 are insertable inside the same torsion spring receiver 222 (FIG. 2A), thereby coupling the plaster ring 140 to the electrical component housing 110. Since there are four notches 322 (FIG. 3) in the exemplary embodiment, four torsion springs 400 are used. However, in alternative exemplary embodiments a different number of torsion springs 400 are capable of being used. This process is described in further detail below with reference to FIGS. 5A and 5B.

FIG. 5A is a perspective view of an electrical component assembly 510 and illuminated message panel 150 of the recessed emergency lighting device 100 of FIG. 1A in accordance with an exemplary embodiment of the present invention. FIG. 5B is a cross-sectional view of the exemplary electrical component assembly 510 and illuminated message panel 150 of FIG. 5A. Referring to FIGS. 1A, 1C, 5A and 5B, the combination electrical component assembly 510 and illuminated message panel 150 includes an electrical component assembly 510, an internal power supply 540, one or more light sources 550, and a lens 570. The exemplary electrical component assembly 510 is fabricated from plastic; however, in alternative embodiments, other suitable insulating materials known to people having ordinary skill in the art, including, but not limited to, polymers, are used.

The electrical component assembly 510 includes a first panel 512 and a second panel 513. The second panel 513 is coupled to the first panel 512 and collectively forms a front panel 514, a rear panel 515, a first side 516, a second side 517, a top side 518, and a cavity 519 surrounded by each of the front panel 514, the rear panel 515, the first side 516, the second side 517, and the top side 518. According to one exemplary embodiment, the first panel 512 is removably coupled to the second panel 513 using snap-fits, clips, or other known fastening devices. Each of the first side 516 and the second side 517 include a snap clip 520 extending outwardly from the first and second sides 516 and 517, respectively. The snap clips 520 are bendable and snap-fit within the respective snap slot 318 (FIG. 3) of the plaster ring 140 when the electrical component assembly 510 is coupled to the plaster ring 140. The cavity 519 forms an area for housing internal electrical and/or mechanical components, which in certain exemplary embodiments includes the internal power supply 540 and one or more light sources 550, and a portion of the lens 570. According to one exemplary embodiment, the electrical component assembly 510 has a length of about 16.5 inches, a height of about 4.2 inches, and a width of about 1.1 inches. However, the dimensions of the electrical component assembly 510 are variable.

The internal power supply 540 is housed within the electrical component assembly 510 and provides power to the light sources 550 using an electrical wire, conductive tracing on a circuit board 590, or a combination of electrical wires and conductive tracings. The internal power supply 540 is any suitable device capable of storing power and providing that power to the light sources 550 during power outages or other emergency situations. In certain exemplary embodiments, the internal power supply 540 providing electrical power to the light sources 550 when an external power supply is not available or has been temporarily been disrupted. In one exemplary embodiment, the internal power supply 540 is two four-packs of AA size batteries, but other types, sizes, and/or number of batteries, such as rechargeable batteries, dry cell batteries, lead acid batteries, other types of batteries, or any other suitable storage device presently existing or made available in the future are capable of being used in conjunction with or as the internal power supply 540.

In an exemplary embodiment, a circuit board 590 is housed within the electrical component assembly 510 and is substantially rectangular in shape. In alternative embodiments the circuit board is capable of having any geometric or non-geometric shape. The circuit board 590 includes a first latitudinal edge 591, a second latitudinal edge 592 positioned opposite the first latitudinal edge 591, a first longitudinal edge 593, and a second longitudinal edge 594 positioned opposite the first longitudinal edge 593. The first longitudinal edge 593 extends between the first latitudinal edge 591 and the second latitudinal edge 592. Similarly, the second longitudinal edge 594 extends between the first latitudinal edge 591 and the second latitudinal edge 592. The circuit board 590 is coupled to a portion of the electrical component assembly 190 using a fastening device (not shown), such as a clip, screw, a sliding track, or other known device. In certain exemplary embodiments, the circuit board 590 is substantially planar and is positioned within a vertical plane that is substantially perpendicular to the plane of the ceiling 190 once the recessed exit sign 100 is properly mounted within the ceiling 190. Thus, the first latitudinal edge 591 is positioned adjacent the first side 516 of the electrical component assembly 510, the second latitudinal edge 592 is positioned adjacent the second side 517 of the electrical component assembly 510, and the first longitudinal edge 593 is positioned adjacent the top side 518 of the electrical component assembly 510.

The exemplary circuit board 590 includes several electrical components coupled or electrically coupled thereto, including the light sources 550 that are electrically coupled together by traces (not shown) etched into the circuit board 590. The exemplary circuit board 590 is fabricated using conducting layers and insulating layers, wherein the conducting layers are typically made of thin copper foil and the insulating layers are made of a dielectric material. Some examples of potential dielectric layers used for the circuit board 590 include, but are not limited to, polytetrafluoroethylene, FR-4, FR-1, CEM-1, or CEM-3.

In one exemplary embodiment, the light sources 550 are LEDs. Each LED includes a chip of semi-conductive material that is treated to create a positive-negative ("p-n") junction. When the LED is electrically coupled to a power source, current flows from the positive side to the negative side of each junction, causing charge carriers to release energy in the form of incoherent light.

The wavelength or color of the emitted light depends on the materials used to make the LED. For example, a blue or ultraviolet LED can include gallium nitride ("GaN") or indium gallium nitride ("InGaN"), a red LED can include aluminum gallium arsenide ("AlGaAs"), and a green LED can include aluminum gallium phosphide ("AlGaP"). Each of the LEDs are capable of producing the same or a distinct color of light. For example, the LEDs can include one or more non-white LEDs, such as red, yellow, amber, green, or blue LEDs.

In certain exemplary embodiments, an optically transmissive or clear material (not shown) encapsulates at least a portion of each LED. This encapsulating material provides environmental protection while transmitting light from the LEDs. For example, the encapsulating material can include a conformal coating, a silicone gel, a cured/curable polymer, an adhesive, or some other material known to a person of ordinary skill in the art having the benefit of the present disclosure. In certain exemplary embodiments, phosphors are coated onto or dispersed in the encapsulating material for creating different colored light.

In certain exemplary embodiments, the light sources 550 includes one or more arrays of LEDs that are collectively configured to produce a lumen output from 1 lumen to 5000 lumens. Although illustrated in FIG. 5B as including LEDs 550 arranged in a substantially linear geometry, a person of ordinary skill in the art having the benefit of the present disclosure will recognize that the LED light sources 550 are capable of being arranged in any geometry.

The LEDs 550 are electrically coupled to, and in one exemplary embodiment, mounted onto, the circuit board 590. The LEDs 550 extend beyond the second longitudinal edge 594 and are substantially oriented along a plane that is parallel or substantially parallel to the plane that the circuit board 590 is oriented. The LEDs 550 produce light that is emitted through all or portions of the lens 570, as further discussed below. During normal operation, the LEDs 550 are supplied power from the external power source. During a power interruption of the external power source, the internal power supply 540 supplies back-up power to the LEDs 550 so that the LEDs 550 can function continuously without interruption. The internal power source 540 is designed to provide emergency back-up power for a predetermined time period. The LEDs 550 are powered by the internal power source 540 until either the power from the external power source is restored or the charge on the internal power source 540 is depleted. Although FIG. 5B illustrates twelve LEDs 550, this number is exemplary and the use of greater or fewer LEDs 550 is within the scope and spirit of the exemplary embodiment. According to some exemplary embodiments, the LEDs 550 emit light in only one color. In alternative embodiments, the LEDs 550 emit light in two or more different colors. In the embodiments with two or more different colored LEDs 550, the LEDs of one color can operate simultaneously with the LEDs of another color or the LEDs of one color can operate in lieu of the LEDs of another color.

The lens 570 includes a front surface 572 and a rear surface (not shown), which collectively form the lens' top edge 575, bottom edge 576, first side edge 577, and second side edge 578. While the lens 570 in this exemplary embodiment is substantially rectangular, the lens 570 is capable of being any geometric or non-geometric shape without departing from the scope and spirit of this disclosure. The top edge 575 is formed having one or more recesses 579 for inserting a portion of the LEDs 550 therein. In one example, each LED 550 is inserted into an individual recess 579. In certain exemplary embodiments, the recess 579 is shaped according to the profile of the inserted portion of the LED 550. In another exemplary embodiment, all the LEDs 550 are inserted into a single recess extending substantially along the length of the top edge 575. The lens 570 is removably coupled to the electrical component assembly 510 by inserting the LEDs 550 into the one or more recesses 570 and using fasteners, clips, snap fittings, screws, or any other coupling device, fastener, or method known to people having ordinary skill in the art to secure the lens 570 to a portion of the interior of the electrical component assembly 510.

In one exemplary embodiment, the lens 570 is fabricated from a translucent plastic. Alternatively, other methods for making the lens 570 known to people having ordinary skill in the art are used. In one example, the front surface 572 and/or the rear surface is clear and translucent, but at least some portions of the front surface 572 and the rear surface are made non-translucent by a manner known in the art, such as by the application of paint or other masking medium. The portions of the front surface 572 and/or the rear surface that remain translucent form the word "EXIT" in one exemplary embodiment. Although the word "EXIT" is used in the exemplary embodiment, the portions of the front surface 572 and/or the rear surface that remain translucent are capable of being used to form other words, symbols, indicias, or a combination thereof in other exemplary embodiments.

In another example, the front surface 572 and/or the rear surface are generally non-transparent and include four light passageway openings that define four letters, or four indicia, in capitalized mode that spell out the word "EXIT". Hence, light beams projected from one or more LEDs 550 pass through each light passageway opening for eventual viewing by an observer. Although four light passageway openings are described with regard to the exemplary embodiment, any number of light passageway openings are employable for illustrating any other word, symbol, or illustration without departing from the scope and spirit of this disclosure.

In one exemplary embodiment, the lens 570 is about 0.4 inches wide near the top edge 575 and tapers in width as it proceeds to the bottom edge 576. Once the lens 570 is installed within the electrical component assembly 510, the lens 570 extends a distance of about 7.0 inches beyond the profile of the electrical component assembly 510. However, in other exemplary embodiments, the lens 570 does not taper and/or the width of the lens 570 and/or the distance that the lens 570 extends beyond the profile of the electrical component assembly 510 is greater or lesser without departing from the scope and spirit of this disclosure.

The illuminated message panel 150 is assembled by obtaining the second panel 513. The internal power supply 540 is electrically coupled to the LEDs 550 positioned along the circuit board 590. The internal power supply 150, the LEDs 550, and circuit board 590 are positioned within the second panel 513. The lens 570 is coupled to the LEDs 550 along its top edge 575 and is also secured to the second panel 513. The first panel 512 is coupled to the second panel 513, thereby forming the illuminated message panel 150. Although one method for forming the illuminated message panel has been provided, other methods are used in other exemplary embodiment. The steps provided are not to be construed as having any particular order.

Referring to FIGS. 1A-5B, an exemplary method for installing the recessed emergency lighting device 100 is described. While the exemplary embodiment will present the method in a series of steps, the organization of those steps as they are presented ins not intended to be limiting. Instead, some steps are capable of being completed before or after other steps without departing from the scope or spirit of this disclosure. In addition, alternative methods include additional steps before, after, or mixed throughout the steps provided or may eliminate or combine some of the steps from the exemplary method.

Turning now to the exemplary method for installing the recessed exit sign 100, the electrical component housing 110 is coupled to one or more support beams (not shown), or other support structures, located above a ceiling 190. The electrical component housing's first plate 210 is positioned below the second plate 230 so that the slot 220 is positioned adjacent to the ceiling 190. One method for coupling the electrical component housing 110 to the support beams utilizes the hanger bars 195. However, other methods known to people having ordinary skill in the art are used in other alternative embodiments.

The ceiling 190 is installed below and adjacent to the first plate 210. In an alternative embodiment for a drop or tile ceiling, the ceiling 190 and the electrical component housing are capable of being integrated into a single product that is provided to speed installation. Returning to the exemplary embodiment, a hole 199 is cut through the ceiling 190 to provide access to the slot 220. In an alternative embodiment, the hole 199 is cut prior to the ceiling 190 being installed. The hole 199 allows the plaster body 308 to be inserted therethrough and into the slot 220 and the cavity 260. In one exemplary embodiment, the hole 199 is about the size of the slot 220; but is slightly larger in other exemplary embodiments. The hole 199 ranges in size from about the size of the slot 220 to about the size of the first plate 210.

A torsion spring 400 is coupled to each plaster ring's notch 322 according to the manner previously described. To install the plaster ring 140 to the electrical component housing 110, the brackets 420 and 430 squeezed together so that the bracket ends 422 and 432 move closer together. Each bracket end 422 and 432 of the same torsion spring 400 is inserted into the same torsion spring receiver 222 and then released. Once each of the torsion springs 440 is coupled to the respective torsion spring receiver 222, the plaster ring 140 is slid towards the ceiling 190. The plaster body 308 is slid into the cavity 260 and the plaster plate 302 moves adjacent to the ceiling 190. Thus, the ceiling 190 is positioned between the plaster plate 302 and the electrical component housing 110. The torsion springs 400 provides a force on the plaster plate 302 so that it remains adjacent to the ceiling 190.

Plaster is then placed along the second side 142 of the plaster plate 302 and around an adjacent portion of the ceiling 190 so that the ceiling 190 is blended into the second side 142 of the plaster plate 302. Thus, when viewing the ceiling 190 and plaster ring 140 from the floor, a viewer observes the plaster ring's aperture 319 and the ceiling 190 surrounding the aperture. The plaster plate 302 is not visible according to some of the exemplary embodiments.

The electrical component assembly 510 of the illuminated message panel 150 is inserted through the plaster ring's aperture 319 so that the electrical component assembly proceeds through the slot 22 and into the cavity 260. As the electrical component assembly 510 is slid into the cavity 260, the snap clips 520 of the electrical component assembly 510 bends and snaps into the respective snap slot 318 of the plaster ring 140. Although one method for installing the recessed emergency lighting fixture 100 has been described, other methods for installing the recessed emergency lighting fixture 100 are used in other exemplary embodiments. This installation results in a quiet ceiling and appears that there is a hole 199 in the ceiling 190 and a lens 570 extending through the hole 199. The plaster ring 140 is typically not visible to an observer. To remove the illuminated message panel 150 from the snap slots 318, the snap clips 520 are bent out of the snap slots 318 using a screwdriver or other tool, thereby allowing the illuminated message panel 150 to be slid out from the plaster ring 140.

Although each exemplary embodiment has been described in detail, it is to be construed that any features and modifications that are applicable to one embodiment are also applicable to the other embodiments. Furthermore, although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A recessed emergency lighting device, comprising:
an electrical component housing comprising a cavity therein;
a plaster ring comprising:
a plaster plate comprising an opening therethrough; and
a body extending substantially orthogonally from a perimeter of the opening towards the electrical component housing; and
an illuminated message panel comprising an electrical component assembly inserted through the opening and into the cavity, wherein the electrical component assembly is positioned within the electrical component housing.

2. The recessed emergency lighting device of claim 1, wherein the electrical component housing and the plaster plate are separated by a ceiling panel once the device is installed.

3. The recessed emergency lighting device of claim 1, wherein the electrical component housing further comprises at least one torsion spring receiver, and wherein the plaster ring comprises at least one torsion spring, the torsion spring being removably coupled to a respective torsion spring receiver.

4. The recessed emergency lighting device of claim 1, wherein the thickness of the plaster plate is tapered, inner portions of the plaster plate being thicker than outer portions of the plaster plate.

5. The recessed emergency lighting device of claim 1, wherein the body is inserted within the cavity.

6. The recessed emergency lighting device of claim 5, wherein the illuminated message panel is coupled to the body of the plaster ring.

7. The recessed emergency lighting device of claim 1, wherein the body comprises one or more snap slots formed therein, and wherein the electrical component assembly comprises one or more snap clips extending outwardly from an exterior surface of the electrical component assembly, the snap clips being removably coupled to the snap slots.

8. The recessed emergency lighting device of claim 1, wherein the electrical component assembly comprises an aperture formed at one end, and positioned adjacent the opening of the plaster plate, and wherein the electrical component assembly further comprises:
an internal power source; and
one or more light sources electrically coupled to the internal power source,
wherein a lens inserted within the aperture extends beyond a profile of the electrical component assembly.

9. The recessed emergency lighting device of claim 8, wherein the one or more light sources comprise light emitting diodes (LEDs).

10. The recessed emergency lighting device of claim 1, wherein the electrical component assembly comprises an aperture formed at one end, and wherein the electrical component assembly comprises:
a circuit board;
one or more light emitting diodes (LEDs) electrically coupled to the circuit board; and
a lens comprising a first longitudinal side and a second longitudinal side, the first longitudinal side inserted within the aperture and positioned adjacent the one or more LEDs, and the second longitudinal side positioned outside the electrical component assembly.

11. The recessed emergency lighting device of claim 10, wherein the first longitudinal side comprises one or more recesses, the one or more LEDs being positioned within the recesses.

12. The recessed emergency lighting device of claim 1, wherein the illuminated message panel further comprises a lens that is removably coupled to the electrical component assembly.

13. A recessed emergency lighting device, comprising:
an electrical component housing forming a cavity therein; and
an illuminated message panel comprising:
an electrical component assembly comprising a top edge at one end and an aperture at an opposing end, the electrical component assembly slidably insertable into the cavity;
a circuit board comprising a first longitudinal end, a second longitudinal end, a first latitudinal end, and a second latitudinal end and disposed within the electrical component assembly, the first longitudinal end, the second longitudinal end, the first latitudinal end, and the second latitudinal end forming a circuit board profile, the second longitudinal end being positioned adjacent the top edge, and the first longitudinal end being positioned adjacent the aperture;
one or more light emitting diodes (LEDs) coupled to the circuit board adjacent the first longitudinal end, the one or more LEDs extending beyond the circuit board profile; and
a lens comprising a first longitudinal side and a second longitudinal side, the first longitudinal side inserted within the aperture and positioned adjacent the one or more LEDs, and the second longitudinal side positioned outside the electrical component assembly.

14. The recessed emergency lighting device of claim 13, wherein the first longitudinal side comprises one or more recesses, the one or more LEDs being positioned within the recesses.

15. The recessed emergency lighting device of claim 13, wherein the electrical component assembly comprises one or more snap clips extending outwardly from an exterior surface of the electrical component assembly, the one or more snap clips coupling the electrical component assembly within the electrical component housing.

16. The recessed emergency lighting device of claim 13, wherein the illuminated message panel further comprises an internal power source housed within the electrical component assembly, the internal power source being electrically coupled to the one or more LEDs.

17. A method for installing a recessed emergency lighting device, comprising:

mounting an electrical component housing to a support structure above a ceiling, the electrical component housing comprising a slot;

installing the ceiling below the electrical component housing and adjacent the slot, wherein the slot faces the ceiling;

forming a hole in the ceiling around the slot;

coupling a plaster ring to the electrical component housing, wherein the plaster ring comprises an opening, the opening being aligned with the slot, and wherein a portion of the plaster ring is below the ceiling and covers edges of the hole; and sliding a portion of an illuminated message panel into the opening and the slot, wherein the illuminated message panel is coupled within the electrical component housing.

18. The method of claim 17, further comprising blending the portion of the plaster ring below the ceiling into the ceiling using a plaster.

19. The method of claim 17, wherein a size of the hole ranges from about a size of the slot to smaller than a size of the portion of the plaster ring below the ceiling.

20. The method of claim 17, wherein the illuminated message panel comprises:

an electrical component assembly comprising a top edge at one end and an aperture at an opposing end, the electrical component assembly slidably insertable into the slot;

a circuit board comprising a first longitudinal end, a second longitudinal end, a first latitudinal end, and a second latitudinal end and coupled within the electrical component assembly, the first longitudinal end, the second longitudinal end, the first latitudinal end, and the second latitudinal end forming a circuit board profile, the second longitudinal end being positioned adjacent the top edge, the first longitudinal end being positioned adjacent the aperture;

one or more light emitting diodes (LEDs) coupled to the circuit board adjacent the first longitudinal end, the one or more LEDs extending beyond the circuit board profile; and a lens comprising a first longitudinal side and a second longitudinal side, the first longitudinal side inserted within the aperture and positioned adjacent the one or more LEDs, and the second longitudinal side positioned outside the electrical component assembly.

21. The method of claim 17, wherein the first longitudinal side of the lens comprises one or more recesses, the one or more LEDs being positioned within the one or more recesses.

* * * * *